US008550829B2

(12) United States Patent
Huang

(10) Patent No.: US 8,550,829 B2
(45) Date of Patent: Oct. 8, 2013

(54) POWER OUTLET WITH JACK SAFETY SHIELD DEVICE

(76) Inventor: Huadao Huang, Yueqing (CN)

( * ) Notice: Subject to any disclaimer, the term of this patent is extended or adjusted under 35 U.S.C. 154(b) by 10 days.

(21) Appl. No.: 13/314,370

(22) Filed: Dec. 8, 2011

(65) Prior Publication Data

US 2012/0149221 A1 Jun. 14, 2012

Related U.S. Application Data

(63) Continuation-in-part of application No. 13/249,882, filed on Sep. 30, 2011, now Pat. No. 8,382,497, and a continuation-in-part of application No. 13/194,989, filed on Jul. 31, 2011, now Pat. No. 8,297,990.

(30) Foreign Application Priority Data

Sep. 30, 2010 (CN) ..... 2010 1 0299583
Dec. 9, 2010 (CN) ..... 2010 1 0580104
Dec. 9, 2010 (CN) ..... 2010 1 0580882

(51) Int. Cl.
*H01R 13/44* (2006.01)

(52) U.S. Cl.
USPC ..... 439/145; 439/127

(58) Field of Classification Search
USPC ..... 439/135–137, 140, 145
See application file for complete search history.

(56) References Cited

U.S. PATENT DOCUMENTS 4,271,337 A * 6/1981 Barkas ..... 200/51.09
4,379,607 A * 4/1983 Bowden, Jr. ..... 439/137
4,544,219 A * 10/1985 Barkas ..... 439/137
4,822,290 A * 4/1989 Cauley et al. ..... 439/137
4,867,694 A * 9/1989 Short ..... 439/137
5,006,075 A * 4/1991 Bowden, Jr. ..... 439/137
5,020,997 A * 6/1991 Calderara et al. ..... 439/137
5,915,981 A * 6/1999 Mehta ..... 439/137
6,056,564 A * 5/2000 Huang ..... 439/145
6,086,391 A * 7/2000 Chiu ..... 439/145
6,217,353 B1 * 4/2001 Yu-Tse ..... 439/145
6,238,224 B1 * 5/2001 Shao ..... 439/137
6,422,880 B1 * 7/2002 Chiu ..... 439/137
6,537,088 B2 * 3/2003 Huang ..... 439/137
6,537,089 B1 * 3/2003 Montague ..... 439/145
6,555,771 B2 * 4/2003 Shao ..... 200/51 R (Continued)

FOREIGN PATENT DOCUMENTS

CN 2476889 Y 2/2002
CN 201490423 U 5/2010
CN 201536176 U 7/2010
CN 102270788 A 12/2011

*Primary Examiner* — Ross Gushi
(74) *Attorney, Agent, or Firm* — Mei & Mark LLP

(57) ABSTRACT

A power outlet includes a casing, a middle-layer support and at least one safety shield device. The middle-layer support includes at least one conductive plug bush and provides guiding jacks corresponding to the position of the conductive plug bush. The safety shield device has a left shield, a right shield and a spring. Each left and right shield extends a shield foot from the underside, respectively. The middle-layer support further includes sliding platforms for movement of the left shield and the right shield. The sliding platform has location holes for insertion of the shield feet. When the left shield and right shield lock, two shield feet respectively match against an opposite inner edge of two location holes on the sliding platform. When the left shield and right shield open, the guiding jack on the middle-layer support exposes.

20 Claims, 6 Drawing Sheets

(56) References Cited

U.S. PATENT DOCUMENTS

| | | | | |
|---|---|---|---|---|
| 6,776,630 | B1 * | 8/2004 | Huang | 439/137 |
| 6,786,745 | B1 * | 9/2004 | Huang | 439/137 |
| 6,893,275 | B2 * | 5/2005 | Ng et al. | 439/137 |
| 6,998,945 | B2 | 2/2006 | Huang et al. | |
| 7,019,952 | B2 | 3/2006 | Huang et al. | |
| 7,179,992 | B1 * | 2/2007 | Packard et al. | 174/53 |
| 7,195,500 | B2 | 3/2007 | Huang et al. | |
| 7,265,956 | B2 | 9/2007 | Huang | |
| 7,289,306 | B2 | 10/2007 | Huang | |
| 7,295,415 | B2 | 11/2007 | Huang et al. | |
| 7,315,227 | B2 | 1/2008 | Huang et al. | |
| 7,317,600 | B2 | 1/2008 | Huang et al. | |
| 7,411,766 | B1 | 8/2008 | Huang et al. | |
| 7,455,538 | B2 * | 11/2008 | Germain | 439/137 |
| 7,510,412 | B1 * | 3/2009 | Valentin | 439/145 |
| 7,538,993 | B2 | 5/2009 | Huang et al. | |
| 7,556,513 | B2 * | 7/2009 | Ng et al. | 439/137 |
| 7,576,959 | B2 | 8/2009 | Huang et al. | |
| 7,588,447 | B1 * | 9/2009 | Ni | 439/137 |
| 7,633,726 | B2 | 12/2009 | Huang et al. | |
| 7,645,148 | B2 * | 1/2010 | Carbone et al. | 439/137 |
| 7,645,149 | B2 * | 1/2010 | Carbone et al. | 439/137 |
| 7,651,347 | B2 * | 1/2010 | Germain et al. | 439/137 |
| 7,651,348 | B2 * | 1/2010 | Huang et al. | 439/137 |
| 7,820,909 | B2 * | 10/2010 | Castaldo et al. | 174/53 |
| 7,833,030 | B1 * | 11/2010 | Huang | 439/137 |
| 7,859,368 | B2 | 12/2010 | Huang et al. | |
| 7,883,346 | B2 * | 2/2011 | Huang | 439/140 |
| 7,887,346 | B1 * | 2/2011 | Huang | 439/140 |
| 7,914,307 | B1 * | 3/2011 | Yang | 439/137 |
| 7,934,935 | B1 * | 5/2011 | Gao | 439/137 |
| 7,942,681 | B2 * | 5/2011 | Ni | 439/137 |
| 7,985,085 | B2 * | 7/2011 | Gao | 439/137 |
| 8,007,296 | B2 * | 8/2011 | Chen et al. | 439/136 |
| 8,044,299 | B2 * | 10/2011 | Weeks | 174/53 |
| 8,100,705 | B2 * | 1/2012 | Chen et al. | 439/137 |
| 8,147,260 | B2 * | 4/2012 | Huang | 439/140 |
| 8,187,011 | B1 * | 5/2012 | Baldwin et al. | 439/137 |
| 8,187,012 | B1 * | 5/2012 | Baldwin et al. | 439/137 |
| 8,193,445 | B2 * | 6/2012 | Li | 174/53 |
| 8,242,362 | B2 * | 8/2012 | Castaldo et al. | 174/53 |
| 8,297,990 | B2 | 10/2012 | Huang | |
| 8,366,463 | B2 * | 2/2013 | Zhang et al. | 439/135 |
| 8,382,497 | B2 | 2/2013 | Huang | |
| 2003/0017731 | A1 * | 1/2003 | Huang | 439/137 |
| 2006/0193092 | A1 | 8/2006 | Huang et al. | |
| 2006/0238933 | A1 | 10/2006 | Huang et al. | |
| 2006/0274463 | A1 | 12/2006 | Huang et al. | |
| 2006/0279886 | A1 | 12/2006 | Huang et al. | |
| 2007/0014068 | A1 | 1/2007 | Huang et al. | |
| 2007/0041134 | A1 | 2/2007 | Huang et al. | |
| 2007/0049077 | A1 | 3/2007 | Germain | |
| 2007/0076337 | A1 | 4/2007 | Huang | |
| 2007/0086127 | A1 | 4/2007 | Huang | |
| 2007/0114053 | A1 * | 5/2007 | Castaldo et al. | 174/53 |
| 2008/0094765 | A1 | 4/2008 | Huang et al. | |
| 2009/0091869 | A1 | 4/2009 | Huang et al. | |
| 2009/0227130 | A1 * | 9/2009 | Carbone et al. | 439/137 |
| 2009/0236115 | A1 * | 9/2009 | Li | 174/53 |
| 2009/0311892 | A1 * | 12/2009 | Weeks | 439/137 |
| 2010/0041259 | A1 * | 2/2010 | Ni | 439/137 |
| 2010/0073178 | A1 | 3/2010 | Huang et al. | |
| 2010/0159722 | A1 * | 6/2010 | Chen | 439/137 |
| 2010/0317207 | A1 * | 12/2010 | Huang | 439/137 |
| 2010/0317208 | A1 * | 12/2010 | Chen et al. | 439/140 |
| 2010/0317209 | A1 * | 12/2010 | Huang | 439/140 |
| 2011/0028011 | A1 * | 2/2011 | Castaldo et al. | 439/140 |
| 2011/0092085 | A1 * | 4/2011 | Gao | 439/137 |
| 2011/0092086 | A1 * | 4/2011 | Gao | 439/137 |
| 2011/0104918 | A1 * | 5/2011 | Chen et al. | 439/136 |
| 2011/0136358 | A1 * | 6/2011 | Zhang et al. | 439/135 |
| 2011/0211283 | A1 | 9/2011 | Huang et al. | |
| 2011/0273803 | A1 | 11/2011 | Huang | |
| 2011/0273813 | A1 | 11/2011 | Huang | |
| 2012/0081819 | A1 * | 4/2012 | Huang | 361/42 |
| 2012/0083142 | A1 * | 4/2012 | Huang | 439/135 |
| 2012/0083143 | A1 * | 4/2012 | Jiang et al. | 439/137 |
| 2012/0149221 | A1 * | 6/2012 | Huang | 439/137 |
| 2012/0170159 | A1 | 7/2012 | Huang | |
| 2012/0187958 | A1 | 7/2012 | Huang | |
| 2012/0287572 | A1 | 11/2012 | Huang | |

* cited by examiner

POWER OUTLET WITH JACK SAFETY SHIELD DEVICE

CROSS-REFERENCE TO RELATED APPLICATIONS

This application claims the benefit of priority of Chinese patent application number 201010580104.6, filed on Dec. 9, 2010, which is incorporated by reference in its entirety. This application claims the benefit of priority of Chinese patent application number 201010580882.5, filed Dec. 9, 2010, and Chinese Patent Application Number 201010299583.4 filed Sep. 30, 2010. This application also claims priority to, and is a continuation in part of, U.S. patent application Ser. No. 13/249,882 entitled Power Outlet with Shield Locking Mechanism, filed on Sep. 30, 2011, the content of which is incorporated herein by reference in its entirety. This application claims the benefit of priority to, and is a continuation in part of, U.S. patent application Ser. No. 13/194,989 entitled Leakage Protection Outlet filed Jul. 31, 2011.

TECHNICAL FIELD

The present disclosure relates generally to power outlets with protection functions. More specifically, the disclosure relates to power outlets with jack safety shields.

BACKGROUND

The existing technology contains two forms of power outlets. For one form, both the left and the right jacks are I-shaped. For the other form, the left jack is I-shaped and the right jack is T-shaped.

A power outlet with a jack shielding device may include an enclosure with a middle-layer support provided in it, conductive plug bushes located below the middle-layer support, and the safety shield device. Guiding jacks are provided on the middle-layer support, corresponding to the positions of the conductive plug bushes. The safety shield device is used to plug the guiding jacks on the middle-layer support and the conductive plug bushes below. The safety shield device for double I-shaped jacks, e.g. the shield device in the Chinese utility model patent No. 200920223089.2, includes left shield, right shield, spring, base connected with the middle-layer support, etc. The safety shield device for left I-shaped and right T-shaped jacks, e.g. the shield device publicized in Chinese utility model patent No. 200920167808.3, includes left shield, right shield, the first spring used for resetting of left and right shields, small shield used for plugging the T-shaped hole, the second spring used for resetting the small shield and its reset mechanism, base connected fixedly with the middle-layer support, etc. When a plug is inserted into the shields, the two shield units are staggered, exposing the conductive plug bush below them. When the plug is pulled out, the shield units, under the action of springs, close the conductive plug bush.

These two kinds of shield devices have the following problems: for safety shield devices for double I-shaped jacks, as there is no sliding platform, it is unsatisfactory to sustain force and therefore unstable. For safety shield devices for left I-shaped and right T-shaped jacks, owing to relatively numerous components, it results in uneven distribution of force, difficult assembly and complicated structure. For safety shield devices with small shields, since a small shield spring is provided with one end fixed and the other end moving together with the small shield, the center of gravity is not consistent, and thus there are problems such as complicated reset mechanism, unassured reliability of action and unsatisfactory flexibility.

SUMMARY

The inventor provides a power outlet with a safety shield device. Such safety shield device is simple in structure and has excellent action reliability.

A power outlet comprises a casing, a middle-layer support and at least one safety shield device. The middle-layer support includes at least one conductive plug bush and provides guiding jacks corresponding to the position of the conductive plug bush. The safety shield device has a left shield, a right shield and a spring. Each left and right shield extends a shield foot from the underside, respectively. The middle-layer support further includes a sliding platform for each shield device for movement of the left shield and the right shield. The sliding platform has location holes for insertion of the shield feet. When the left shield and right shield lock, two shield feet respectively rest against opposite inner edges of the two location holes on the sliding platform. When the left shield and right shield open, the guiding jack on the middle-layer support is exposed.

In an alternative embodiment, the middle-layer support according to the above description further includes a locating wedge and at least one T-shaped guiding jack. A small shield is configured underneath the right shield. The small shield includes a first guide groove to match a right shield guide rail underneath the right shield, a running slope above the small shield where the small shield retracts in a direction normal to an opening direction of the right shield under the effect of a T-shaped plug, a locking notch at a left side of the small shield configured to match a locking block configured at a front of the left shield, a lock-up surface configured to match a front end of the locating wedge, and a second guiding groove configured to match an inclined side face of the locating wedge.

The beneficial effect provided is that, as the left and right shields are positioned by the matching of their respective shield feet and the respective location holes on the sliding platform of the middle-layer support, the need for a shield base is eliminated and therefore the device achieves reduced cost, reliable movement and easy assembly.

Another benefit provided is that, as the small shield is returned by the locating wedge at the middle-layer support, the need for a returnable spring is eliminated and therefore costs are further reduced.

Furthermore, with the lock-up steps provided at an inner edge of the hollow frame of the shield, the shield moves more stably.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments, and, together with the description, serve to explain the principles of the power outlet safety shield device.

DESCRIPTION OF THE EMBODIMENTS

Reference will now be made in detail to the present exemplary embodiments, which are illustrated in the accompanying drawings. Wherever possible, the same reference numbers will be used throughout the drawings to refer to the same or like parts.

Example 1

Figure 1:
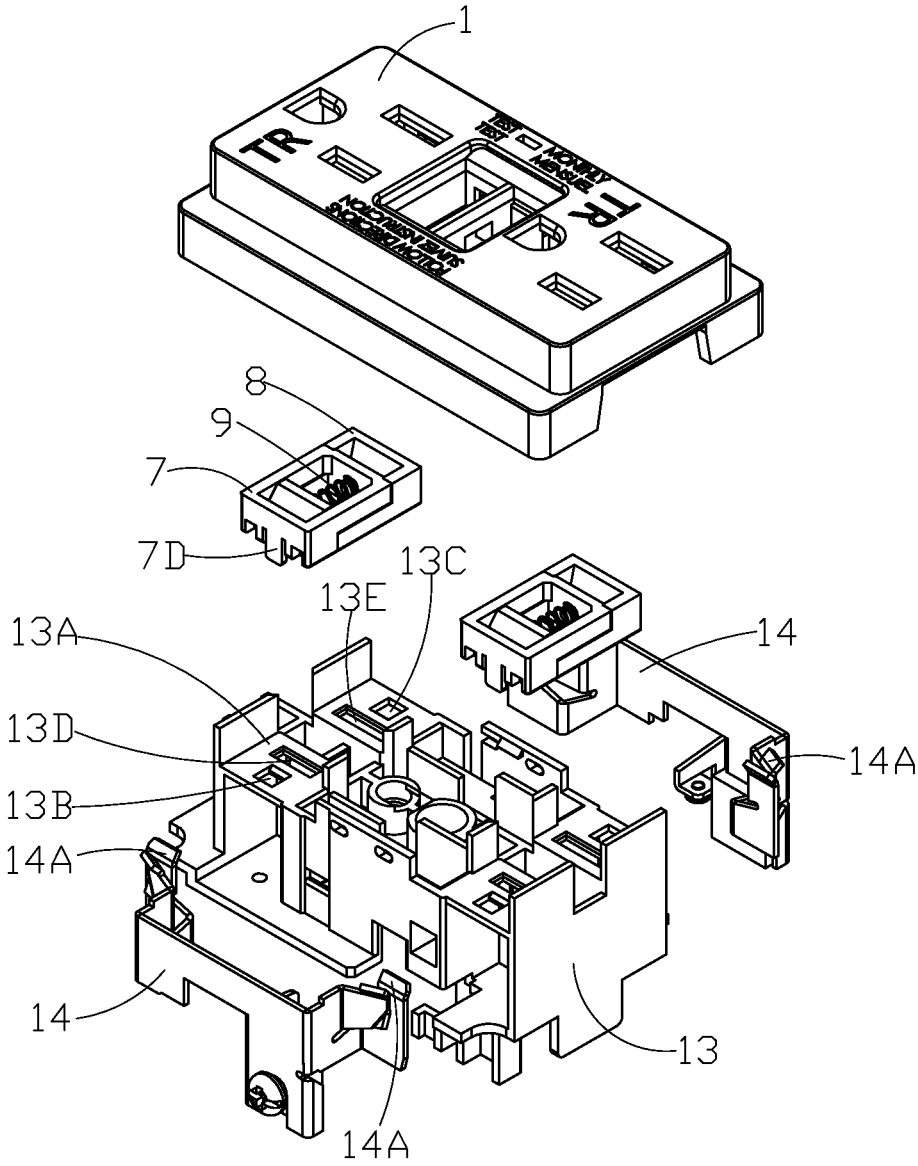
FIG. 1 is an exploded structural diagram of Example 1.
Figure 2:
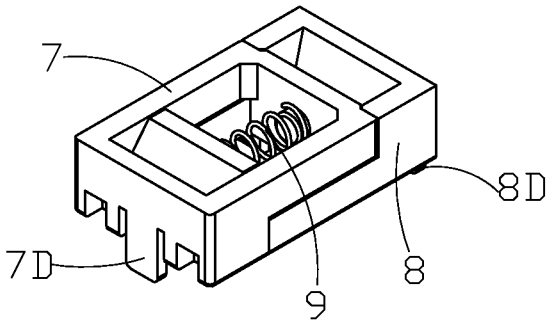
FIG. 2 is a diagram of a safety shield device of Example 1.
Figure 3:
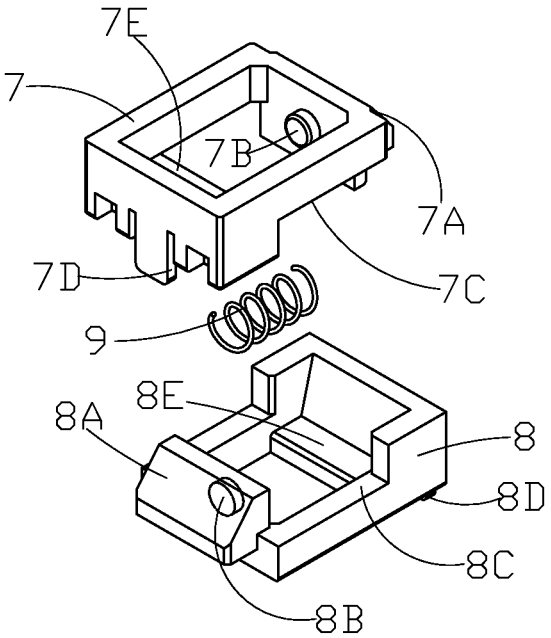
FIG. 3 is an exploded diagram of the safety shield device of Example 1.
Figure 4:
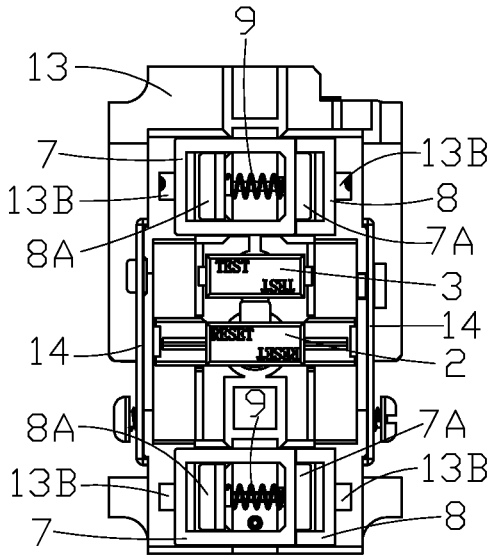
FIG. 4 is a diagram of Example 1 with shields locked (upper cover removed).
Figure 5:
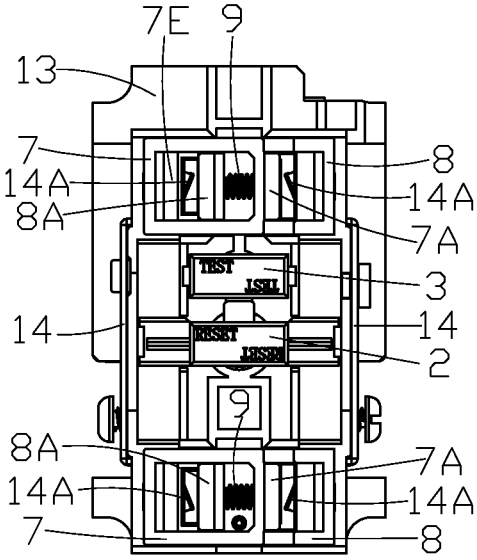
FIG. 5 is a diagram of Example 1 with shields unlocked (upper cover removed).

Referring to FIGS. 1-5, the example is directed at a power outlet with the jacks being I-shaped holes. The power outlet has two sets of jacks and provides two separate sets of safety shield devices. The power outlet with jack safety shield devices of this invention includes a casing with middle-layer support 13 inside (only an upper cover 1 with jacks is shown in the figure; a base is not shown), conductive plug bush 14A below middle-layer support 13 (the conductive plug bush is on conductive metal piece 14). The jack safety shield device is made up of left shield 7, right shield 8 and spring 9. Middle-layer support 13 has guiding jacks (13D, 13E) corresponding to the position of conductive plug bush 14A.

Left shield 7 and right shield 8 respectively include a hollow frame and a stop block (7A, 8A) at the front of the hollow frame. There are matching step type dents (7C, 8C) at the side of both hollow frames. The opening of step type dent 7C at left shield 7 faces upward, the opening of step type dent 8C at right shield 8 faces downward. The left and right shields may slide to match in a crossed way along the step type dents. The stop block may move along both sides of the inner edge of the opposite hollow frame. Stop block 7A and stop block 8A, at the rear side, have spring mounting positions 7B and 8B, respectively. Each end of spring 9 rests against respective spring mounting positions (7B, 8B) of both stop blocks. The spring mounting positions of this example are convex pins. One convex pin is provided on each of the rear sides of the stop blocks of the left and right shields. The convex pins are preferred to be at the same level. Each end of spring 9 is mounted to the convex pin at both stop blocks. The spring mounting position may also be a groove on each rear side of the stop blocks of the left and right shields. Each side of the spring is then mounted into the grooves at both stop blocks.

Stop blocks (7A, 8A) have guiding slopes at the front ends. The guiding slope of left stop block 7A forms a hole lock-up together with the rear wall of the inner edge of the hollow frame of the right shield to block left guiding jack 13E of the middle-layer support. The guiding slope of right stop block 8A forms a hole lock-up together with the rear wall of the inner edge of the hollow frame of the left shield to block right guiding jack 13D of the middle-layer support. That is, each stop block (7A, 8A) cooperates with a step (7E, 8E) of the opposite shield to prevent an object from entering the plug bush below. In this way, the upper cover jacks, guiding jacks (13D, 13E), and plug bushes (14A) are locked-up until appropriate pins of a plug can press against the guiding slopes and slide the shields apart, thereby opening a space through which the plug pins can travel to the plug bushes below. If a foreign object, such as a hairpin or key, is pressed against a guiding slope, thereby moving the guiding slope away from the locked position, the step below will prevent the foreign object from reaching the plug bush below the step.

The hollow frame of left shield 7 has a left lock-up step 7E at the inner edge for sliding under the right shield stop block. The hollow frame of right shield 8 has a left lock-up step 8E at the inner edge for sliding under the left shield stop block. A plug is not allowed to be connected until the stop blocks of both shields move simultaneously and remove respective lock-up steps from the plug pin entry path. This configuration also ensures stable sliding of the shields and prevents relative vertical shaking of the left and right shields. Guiding slopes 7A, 8A are placed above lock-up step 7E, 8E, respectively. The guiding slopes 7A, 8A and lock-up steps 7E, 8E isolate plug bush 14A below so that the power outlet will not be plugged into even when the shield is being pried with a metal bar.

Left shield 7 extends at least one shield foot 7D from its underside. Right shield 8 extends at least one shield foot 8D from its underside. Middle-layer support 13 provides sliding platform 13A for movement of left shield 7 and right shield 8. Sliding platform 13A has location holes (13B, 13C) for insertion of the shield feet (7D, 8D). When the left and right shields close, two shield feet (7D, 8D) respectively rest against the opposite inner edge of two location holes (13B, 13C) at the middle-layer support, clamping against the inner edges of the two location holes by spring 9. The shield device is located against middle-layer support 13. Guiding jacks (13D, 13E) are exposed when the left and right shields open. When the left and right shields are opened, the two shield feet (7D, 8D) can rest against opposite outer edges of the two location holes (13B, 13C). While two shield feet (7D, 8D) are shown, more or fewer shield feet may be used.

Example 2

Figure 6:
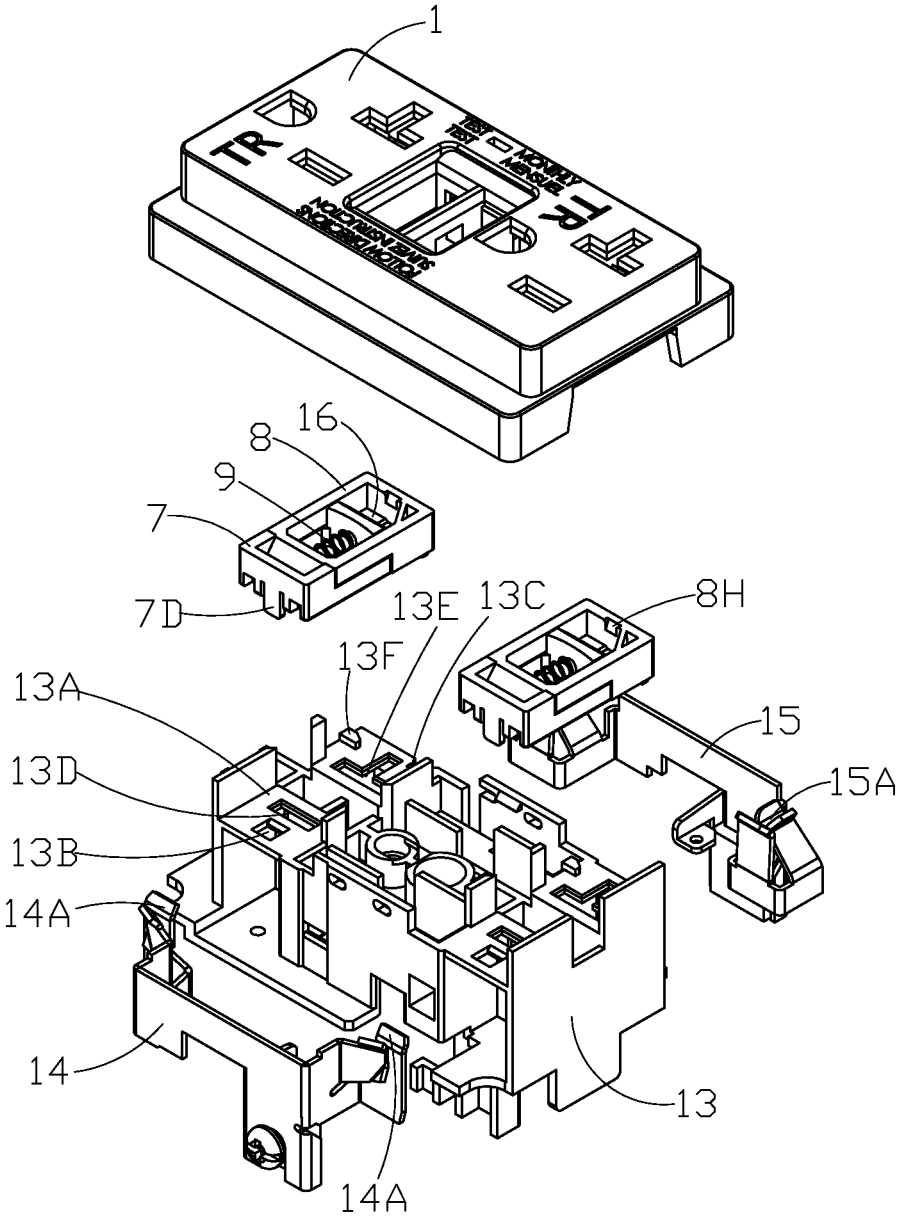
FIG. 6 is an exploded diagram of Example 2.
Figure 7:
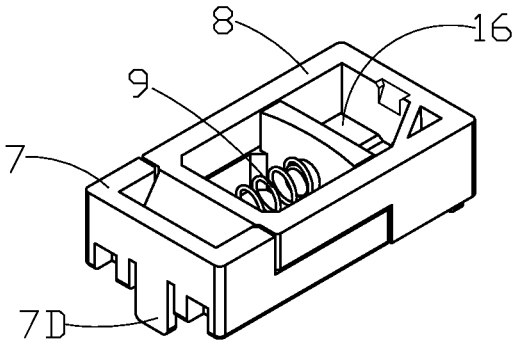
FIG. 7 is a structural diagram of the safety shield device of Example 2.
Figure 8:
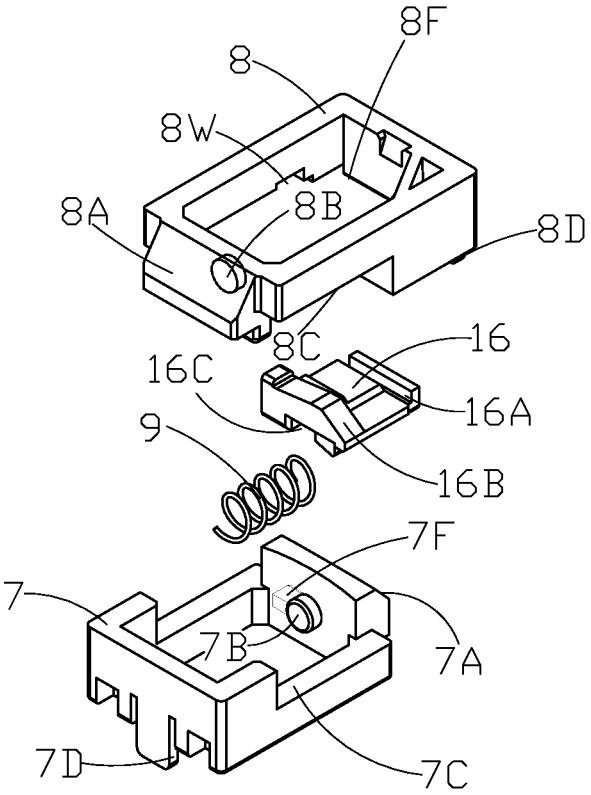
FIG. 8 is an exploded diagram of the safety shield device of Example 2.
Figure 9:
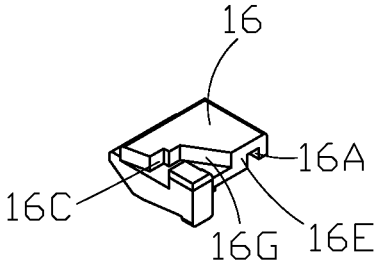
FIG. 9 is a diagram of the bottom side of the small shield.
Figure 10:
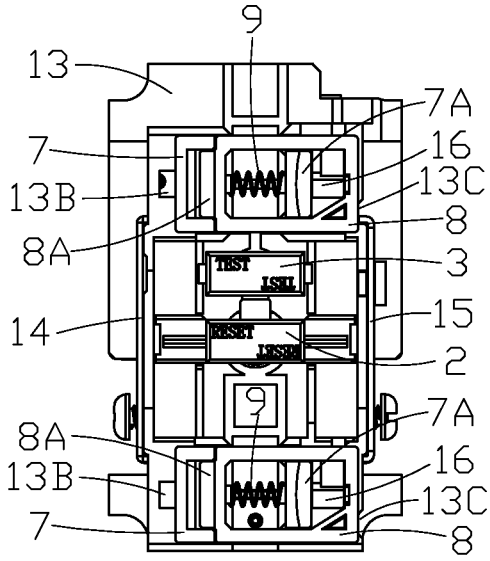
FIG. 10 is a diagram of Example 2 with shields locked (upper cover removed).
Figure 11:
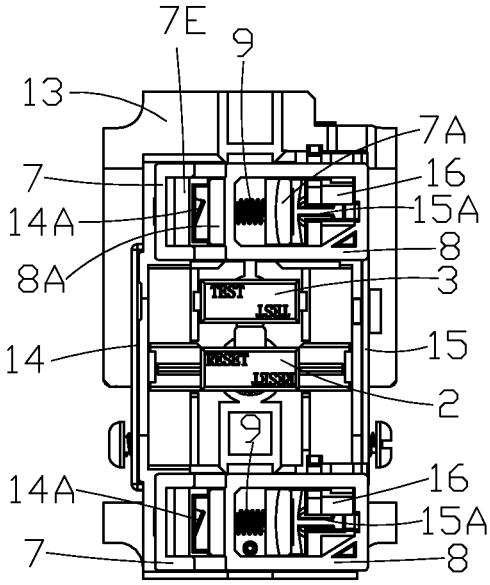
FIG. 11 is a diagram of Example 2 with shields unlocked (upper cover removed).

Referring to FIGS. 6-11, this example is directed at a power outlet with I-shaped jacks on the left and T-shaped jacks on the right. The differences between this example and example 1 are as follows:

The conductive plug bush (14A, 15A) at conductive metal pieces (14, 15) below the upper end face of middle-layer support 13 have different shapes. For example, conductive plug bush 14A is I-shaped and conductive plug bush 15A is T-shaped. Left guiding jack 13D at middle-layer support 13 is an I-shaped hole while right guiding jack 13E is a T-shaped hole. In addition, the middle-layer support provides location hole 13B for insertion of left shield foot 7D and location groove 13C for right shield foot 8D. Unlike the centered left shield foot 7D, right shield foot 8D can be closer to an edge to accommodate the T-shaped jack 13E. And, the corresponding location groove 13C can likewise be off-center to align with the right shield foot 8D without interfering with the function of the T-shaped jack 13E.

Small shield 16 is provided below right shield 8 and serves as a lock-up step. Guide rail 8F is provided below right shield 8 and small shield 16 has guiding groove 16A to match with right shield guide rail 8F. Running slope 16B, provided on an upper surface of small shield 16, may drive small shield 16 to move along the direction normal to the opening direction of the right shield. A sliding platform is provided for sliding of the shields at middle-layer support 13 and small shield 16 is located between right shield 8 and the sliding platform of middle-layer support 13. Locking block 7F is provided at the front end of left shield 7. Small shield 16 has a locking groove 16C to match with left shield locking block 7F. Middle-layer support 13 provides location wedge 13F. Lock-up surface 16E can press against the front end of location wedge 13F. A second guiding groove 16G to match with the inclined side face of the location wedge 13F is provided below small shield 16. The small shield 16 may automatically disengage and unlock when a plug is connected, and may engage and lock when a plug is removed.

The guiding slope at stop block of left shield 7 is steeper than that of the stop block of right shield 8. The left shield stop block is shorter than the right shield stop block. The main parts of small shield 16 and running slope 16B, for instance, are between the inner edge of the right shield hollow frame and the left shield stop block. The guiding slope of the stop block of left shield 7 does not cover the entire inner edge of the right shield hollow frame. Running slope 16B is below the guiding slope of the left shield stop block. The bottom surface of small shield 16 is flush with the bottom face of right shield 8. Right shield 8 also has a notch 8W for lateral movement of small shield 16 at a side surface. Locking block 7F of the left shield is in the middle of the lateral movement direction of the small shield. Locking groove 16C of small shield 16 straddles on left shield locking block 7F. When the front and rear inner walls of locking groove 16C of small shield 16 contact the front and rear surfaces of locking block 7F, they respectively correspond to the locking position and unlocking position of small shield 16. Locking groove 16C and guiding groove 16G of the small shield both are located at the bottom surface of the small shield.

To facilitate the insertion of a T-shaped plug, the rear wall of the inner edge of the hollow frame of right shield 8 has a guiding notch to guide the cross metal piece of T-shaped pin of a plug.

The movements are described in the following process: After unlocking of the shield lock-up mechanism, a plug is connected. The I-shaped left pin of the plug moves downward along the guiding slope of the right shield stop block. The T-shaped right pin of the plug first moves along the left shield stop block to insert into a position so as to expose top running slope 16B of small shield 16, and then moves downward along running slope 16B of small shield 16. The left and right shields open to expose I-shaped guiding jack 13D at the left side of the middle-layer support. Running slope 16B of the small shield retracts upward in the direction normal to the opening direction of the right shield. The first guiding groove at the right side of the small shield slides along the guide rail. The locking groove in the front of the small shield slides and leaves the locking block at the front end of left shield. Second guiding groove 16G below the small shield slides along the guiding slope of guiding wedge 13F at the middle-layer support. That is, the entire small shield retracts by the effect of a T-shaped plug pin and reveals right guiding jack 13E of the middle-layer support below it. When a plug is removed, the left and right shields clamp together by the effect of spring 9, the small shield moves left, driven by the right shield guide rail, and at the same time, the small shield moves downward in the direction normal to the closing direction of the right shield by the effect of guiding wedge 13F at the middle-layer support until locking groove 16C is stopped and located by locking block 7F at the front end of the left shield. Small shield 16 is locked by locking block 7F and location wedge 13F and thus blocks T-shaped guiding jack 13E at the middle-layer support. The safety shield device returns to locked status, and the guiding jacks at the middle-layer support are blocked with the shield.

Other embodiments will be apparent to those skilled in the art from consideration of the specification and practice of the disclosed structures. It is intended that the specification and examples be considered as exemplary only, with a true scope and spirit of the invention being indicated by the following claims.

I claim:

1. A power outlet, comprising:

a casing;

a middle-layer support inside the casing, the middle-layer support comprising at least one guiding jack;

at least one conductive plug bush below the middle-layer support; and at least one safety shield device comprising:

a spring having a first end and a second end;

a left shield and a right shield, each comprising:

a hollow frame comprising first and second opposed planar sides, a front end perpendicular to the first and second opposed planar sides, and a planar rear end perpendicular to the first and second opposed planar sides;

a stop block at the front end of the hollow frame with a guiding slope on an outer surface and a spring mounting position on an inner surface;

a planar lock-up step at an inner edge of the hollow frame, the lock-up step closer to the rear end than to the front end, and the lock-up step perpendicular to the planar rear end and perpendicular to the first and second opposed planar sides; and a shield foot extended from the planar rear end of the hollow frame towards the middle-layer support, wherein:

the at least one guiding jack is vertically aligned with the at least one conductive plug bush to receive a pin of a power plug, the left shield and the right shield are stacked together and slide relative to each other, the first end of the spring rests against the spring mounting position on the stop block of the left shield and the second end of the spring rests against the spring mounting position on the stop block of the right shield, and the middle-layer support further comprises a sliding platform configured for the left shield and the right shield to slide on, the sliding platform having a left location hole for insertion of the shield foot of the left shield and the sliding platform having a right location hole for insertion of the shield foot of the right shield.

2. The power outlet of claim 1, wherein:

at least one of the guiding jacks on the middle-layer support is T-shaped, the middle-layer support further comprises a locating wedge, and the shield device further comprises a small shield stacked beneath the right shield, the small shield comprising:

a first guide groove configured to receive a right shield guide rail on a bottom edge of the right shield;

a running slope on an upper surface of the small shield;

a locking notch at a left side of the small shield configured to receive a locking block on the outer surface of the front end of the left shield;

a lock-up surface configured to receive a front end of the locating wedge; and a second guiding groove configured to receive an inclined side face of the locating wedge, further wherein, when a T-shaped pin of the plug is pressed against the running slope of the small shield, the small shield retracts in a direction normal to a sliding direction of the right shield.

3. The power outlet of claim 2, wherein an inner edge of the rear end of the right shield has a guiding notch to guide a portion of a T-shaped pin of a plug.

4. The power outlet of claim 2, wherein the right shield has a notch in the first opposed side for sliding movement of a portion of the small shield.

5. The power outlet of claim 2, wherein:

the stop block of the left shield is shorter than the stop block of the right shield, and the running slope of the small shield is between the outer edge of the stop block of the left shield and the inner edge of the rear end of the right shield.

6. The power outlet of claim 5, wherein:

the running slope of the small shield is positioned below the guiding slope of the stop block of the left shield, the locking block of the left shield is positioned rearwardly on the left shield with respect to a direction of lateral movement of the small shield, when the small shield is in a locked position, the locking block contacts a first inner wall of the locking notch of the small shield, and when the small shield is in an unlocked position, the locking block contacts an opposed second inner wall of the locking notch of the small shield.

7. The power outlet of claim 6, wherein the locking notch and the second guiding groove of the small shield both are on a bottom surface of the small shield.

8. The power outlet of claim 6, wherein the middle-layer support further comprises a sliding platform to enable the shield device to slide, and wherein the small shield is located between the right shield and the sliding platform.

9. The power outlet of claim 1, wherein the spring mounting positions of the left shield and the right shield are convex pins.

10. The power outlet of claim 1, wherein the spring mounting positions of the left shield and the right shield are grooves.

11. The power outlet of claim 1, wherein at least one of the left shield and the right shield has more than one shield foot.

12. The power outlet of claim 1, wherein:

the middle-layer support comprises at least two sliding platforms that cooperate with one of at least two sets of shield devices, and the sliding platforms are each provided with one set of guiding jacks and at least one fixed position for a shield foot.

13. The power outlet of claim 1, wherein the first and second opposed planar sides of each of the left shield and the right shield each comprise a step-type dent and further wherein the step-type dents of the right shield overlap the step-type dents of the left shield to provide a sliding surface.

14. The power outlet of claim 1, wherein:

the lock-up step of the left shield slides beneath the stop block of the right shield, and lock-up step of the right shield slides beneath the stop block of the left shield, and the guiding slope of the stop block of the left shield together with the lock-up step of the right shield blocks a first guiding jack, and the guiding slope of the stop block of the right shield together with the lock-up step of the left shield blocks a second guiding jack.

15. The power outlet of claim 1, wherein:

when the shield foot of the left shield and the shield foot of the right shield each press against respective locking edges of the left location hole and the right location hole, the safety shield device is locked, and when the shield foot of the left shield and the shield foot of the right shield each press against respective inner edges of the left location hole and the right location hole that are opposite to the locking edges, the safety shield device is unlocked, the safety shield device is open, and the guiding jacks on the middle-layer support are exposed.

16. A power outlet, comprising:

a casing;

a middle-layer support; and at least one safety shield device, wherein:

the middle-layer support comprises at least one conductive plug bush, a locating wedge, and guiding jacks corresponding to the position of the conductive plug bush, at least one of the guiding jacks on the middle-layer support is T-shaped, the safety shield device comprises a left shield, a right shield, a small shield, and a spring, wherein each left and right shield extends a shield foot from the underside, the small shield is beneath the right shield and the small shield comprises:

a first guide groove configured to receive a right shield guide rail on a bottom edge of the right shield;

a running slope on an upper surface of the small shield;

a locking notch at a left side of the small shield configured to receive a locking block on the outer surface of the front end of the left shield;

a lock-up surface configured to receive a front end of the locating wedge; and a second guiding groove configured to receive an inclined side face of the locating wedge, when a T-shaped pin of a plug is pressed against the running slope of the small shield, the small shield slides in a direction normal to a sliding direction of the right shield, the middle-layer support further comprises a sliding platform for movement of the left shield and the right shield, the sliding platform comprises at least two location holes for receiving the shield feet, when the left shield and right shield lock, two shield feet respectively match against opposite inner edges of the two location holes on the sliding platform, and when the left shield and right shield open, the guiding jack on the middle-layer support is exposed.

17. The power outlet of claim 16, wherein:

the running slope of the small shield is positioned below the guiding slope of the stop block of the left shield, the locking block of the left shield is positioned rearwardly on the left shield with respect to a direction of lateral movement of the small shield, when the small shield is in a locked position, the locking block contacts a first inner wall of the locking notch of the small shield, and when the small shield is in an unlocked position, the locking block contacts an opposed second inner wall of the locking notch of the small shield.

18. A safety shield device for a power outlet, comprising:

a spring having a first end and a second end;

a left shield and a right shield, each comprising:

a frame comprising first and second opposed planar sides, a front end perpendicular to the first and second opposed sides, and a planar rear end perpendicular to the first and second opposed planar sides;

a stop block at the front end of the hollow frame with a guiding slope on an outer surface and a spring mounting position on an inner surface;

a lock-up step at an inner edge of the hollow frame, the lock-up step being closer to the rear end than to the front end, and the lock-up step being perpendicular to the planar rear end and perpendicular to the first and second opposed planar sides; and a shield foot extended from the rear end of the hollow frame, wherein:

the left shield and the right shield are configured to stack together and to slide relative to each other, the first end of the spring rests against the spring mounting position on the stop block of the left shield and the second end of the spring rests against the spring mounting position on the stop block of the right shield.

19. The safety shield device of claim 18 further comprising:

a small shield stacked beneath the right shield, the small shield comprising:

a first guide groove configured to receive a right shield guide rail on a bottom edge of the right shield;

a running slope on an upper surface of the small shield;

a locking notch at a left side of the small shield configured to receive a locking block on the outer surface of the front end of the left shield;

a lock-up surface on a bottom surface; and a second guiding groove on the bottom surface, wherein the running slope of the small shield is configured to move in a direction normal to a sliding direction of the right shield.

20. The safety shield device of claim 19, wherein:

the running slope of the small shield is positioned below the guiding slope of the stop block of the left shield, the locking block of the left shield is positioned rearwardly on the left shield with respect to a direction of lateral movement of the small shield, when the small shield is in a locked position, the locking block contacts a first inner wall of the locking notch of the small shield, and when the small shield is in an unlocked position, the locking block contacts an opposed second inner wall of the locking notch of the small shield.

* * * * *